US011528981B2

(12) United States Patent
Messenger

(10) Patent No.: US 11,528,981 B2
(45) Date of Patent: Dec. 20, 2022

(54) COSMETIC SOURCE APPLICATOR WITH MULTIPLE CARTRIDGES

(71) Applicant: Mark Andrew Messenger, Sarasota, FL (US)

(72) Inventor: Mark Andrew Messenger, Sarasota, FL (US)

( * ) Notice: Subject to any disclaimer, the term of this patent is extended or adjusted under 35 U.S.C. 154(b) by 0 days.

(21) Appl. No.: 15/876,212

(22) Filed: Jan. 22, 2018

(65) Prior Publication Data

US 2019/0254406 A1 Aug. 22, 2019

Related U.S. Application Data

(60) Provisional application No. 62/448,517, filed on Jan. 20, 2017.

(51) Int. Cl.

| | |
|---|---|
| ***A45D 40/24*** | (2006.01) |
| ***A45D 34/00*** | (2006.01) |
| ***A45D 33/00*** | (2006.01) |

(52) U.S. Cl.

CPC ..... *A45D 40/24* (2013.01); *A45D 33/006* (2013.01); *A45D 34/00* (2013.01); *A45D 2034/005* (2013.01)

(58) Field of Classification Search

CPC ..... A45D 33/006; A45D 2034/005; A45D 40/24; A45D 34/00; A45D 2200/10; A45D 2200/1009; A45D 2200/1018; A45D 2200/1036; A45D 2200/1045; A45D 2200/1081

USPC ..... 132/320; 206/77.1, 823, 581

See application file for complete search history.

(56) References Cited

U.S. PATENT DOCUMENTS

| | | | | |
|---|---|---|---|---|
| 5,163,581 | A | 11/1992 | Lombardi, Jr. | |
| 5,495,632 | A | 3/1996 | Baker | |
| 5,904,151 | A * | 5/1999 | Gueret | A45D 40/00 132/293 |
| 6,269,821 | B1 * | 8/2001 | Berke | A45D 34/04 132/317 |
| 6,401,289 | B1 | 6/2002 | Herbert | |
| 6,412,997 | B2 * | 7/2002 | Berke | A45D 34/04 401/138 |
| 7,597,211 | B2 | 10/2009 | Kang | |
| 7,650,995 | B2 | 1/2010 | Assie | |
| 8,015,653 | B2 | 11/2011 | Bargiel | |

(Continued)

*Primary Examiner* — Rachel R Steitz

(74) *Attorney, Agent, or Firm* — Dorothy S. Morse

(57) ABSTRACT

A cosmetic source applicator is provided for users to decorate skin and/or place at least one skin product in contact with recipient skin. It may comprise one or multiple containers and one or multiple interchangeable cartridges. Each container provides secure support of one cartridge during skin decoration use over an open-topped bottom recess. A cartridge may hold, store, or be the cosmetic source, and be constructed in one or multiple sizes, shapes and/or materials. Each cartridge also has opposing top and bottom surfaces which may be reversed in positioning for skin decoration successively by both surfaces. Containers may attach to another container for increased ease in reaching different areas on the body. For convenient storage and travel, containers may store a cartridge before, during and after use. The cosmetic source applicator's use of single-use cartridges, disposable cartridges, and multi-use cartridges limit cartridge exposure to bacteria and other environmental germs.

20 Claims, 10 Drawing Sheets

(56) References Cited

U.S. PATENT DOCUMENTS

| | | | | |
|---|---|---|---|---|
| 8,141,565 | B2 | 3/2012 | Slavin | |
| 8,713,739 | B1 | 5/2014 | Alas | |
| 9,079,003 | B1 | 7/2015 | Hoogerwerf | |
| 9,080,267 | B2 | 7/2015 | Batchvarova | |
| 9,504,303 | B2 | 11/2016 | Viscomi | |
| 10,058,159 | B2 | 8/2018 | Kronethal | |
| 2004/0071494 | A1 | 4/2004 | Staniforth | |
| 2004/0184864 | A1* | 9/2004 | White | A45D 34/042 401/6 |
| 2006/0010625 | A1 | 1/2006 | Tapper | |
| 2006/0075592 | A1* | 4/2006 | Sommers | A45D 34/04 15/244.1 |
| 2006/0107967 | A1* | 5/2006 | Kawai | A45D 34/041 132/320 |
| 2008/0104787 | A1 | 5/2008 | Keenan | |
| 2012/0097183 | A1* | 4/2012 | Miller | A45D 34/042 132/320 |
| 2017/0127799 | A1 | 5/2017 | Chung | |

* cited by examiner

COSMETIC SOURCE APPLICATOR WITH MULTIPLE CARTRIDGES

CROSS-REFERENCE TO RELATED APPLICATIONS

None.

BACKGROUND OF THE INVENTION— FIELD OF THE INVENTION

The invention disclosed herein relates to cosmetic applicators, and more particularly to a cosmetic source applicator system with varying combinations of applicator containers that may be used independently or attached to one another during use, one or more cosmetic sources providing a grooming improvement, and multiple interchangeable cartridges configured for insertion into an open recess in one of the applicator containers for distributing skin products and/or providing other skin improvement (such as through exfoliation or massage, but not limited thereto).

BACKGROUND OF THE INVENTION— DESCRIPTION OF THE RELATED ART

A significant number of individuals frequently use cosmetic sources, including personal soap, personal deodorant, makeup, makeup remover, shampoo, conditioner, body wash, skin care product (e.g. loofa, exfoliator, massager), or hair care product and cosmetic source applicators; on a regular basis. These cosmetic sources are typically stored outside of their original packaging and/or in containers (i.e. jars, sticks, bottles, tubes, loofas, or reservoirs, cosmetic applicators) on shelves, countertops, sink-tops, cabinets, bathtub/shower floors or ledges. These cosmetic source applicators are typically manufactured in a variety of different materials, shapes, sizes and purposes, making it difficult to learn how to properly and comfortably apply the cosmetic source. Furthermore, the known prior art makes it difficult for the user to benefit from conveniently being able use their own cosmetic source applicator to apply their own cosmetic sources when traveling and/or away from their place of residence.

The currently known cosmetic sources and cosmetic source applicators are typically sold in a multiple-use amount (more than one application) without a universal method of application. This is often inconvenient as the user must keep the cosmetic source clean over a multiple-use period of time, and repurchase a multiple-use cosmetic source, and/or cosmetic source applicator during a need of only a single-use cosmetic source, and/or cosmetic source applicator. Also, it is often inconvenient for users to have to store the various cosmetic sources outside original packaging, and/or in multiple containers, as defined above. There exists a need for a convenient cosmetic source applicator with multiple interchangeable and universal cartridges Convenience: When using the present invention herein, a user will not have to purchase separate travel size cosmetic sources, or invest in a product that lasts longer than needed or desired. Each cartridge will have, or be, a cosmetic source, desired by the user, which will allow for a single-use application and finishing of the cosmetic source, and then be recycled, disposed of appropriately, or washed and reused.

Furthermore, the user will have the option of using a cartridge with the desired cosmetic source, or be the cosmetic source in a multiple-use application and finalization of the cosmetic source, then stored in the container, until next use. Further reason for convenience is that the single-use cartridge will not require the user to clean or take care of anything after use, other than recycling, or proper disposal of the used cartridge, while the container is kept for future use. Multiple-use cartridges, allow the user to not worry about storage of the unused cosmetic source, due to the cartridge being stored in the container until use has been exhausted.

The cosmetic source applicator of the present invention will also allow users to have one method of application, which is convenient when traveling, familiarity of method of application, and confidence in expected experience of use.

Lastly, the present invention disclosed herein provides the option of a cartridge which will allow the user to put their own cosmetic source of choice into the cartridge for a single-use, or multiple-use application and finalization of their cosmetic source(s).

Variety: the cartridge of the present invention will vary in as many varieties of cosmetic sources that are, but not limited to, personal soap, personal deodorant, makeup, makeup remover, shampoo, conditioner, body wash, skin care product (e.g. loofa, exfoliator, massager), or hair care product. The cartridge will be single-use or multiple-use sizes. There will be various shapes that benefit the cosmetic source applicator's efficiency and effectiveness of application and finalization of cosmetic source(s). It is believed that skincare products desired by the user will be able to be held by the cartridge or be a cartridge, as defined elsewhere herein.

Organization: the cosmetic source applicator allows for the user to have most desired skincare products stored in a way which promotes at least one of the following: sterilization, cleanliness, shelf space, travel kits and storage kits.

Reasonableness: investment in the cosmetic source applicator of the present invention will be less costly than purchasing the same and/or similar cosmetic source individually. The container will only need to be purchased one-time for perpetual use. The cartridge will be purchased in amounts that are single-use or multiple-use, which best fit the user's preference, and then be recycled or washed for further use. Therefore, investing in the cosmetic source applicator for cosmetic source application and finalization is more economic than other ways of purchasing and using similar/same cosmetic source(s). Further, the cosmetic source applicator will promote a clean and ergonomic method of application and finalization of cosmetic source(s), which allow for the use of the cosmetic source(s) in a way that prevents germs (bacteria) from collecting on the skincare product, or other cosmetic sources.

Lastly, the cosmetic source applicator of the present invention will allow for users to treat their skin or other individual's skin with products that would otherwise cost significantly more due to unique packaging costs, and multiple-use cosmetic source purchases that will become obsolete over the period of time needed to consume the product due to bacteria, becoming misplaced, and/or stolen.

BRIEF SUMMARY OF THE INVENTION

This summary is provided to introduce several preferred embodiments of the present invention herein in their most simplified form that are further described below in the "Detailed Description" section of this invention disclosure. Thus, this summary is not intended to identify key features of the claimed subject matter, nor is it intended to be used to limit the scope of the claimed subject matter.

In accordance with aspects of the present disclosure, a cosmetic source applicator is provided for applying cosmetic source to a user's or another individual's skin. The cosmetic source applicator includes a preferably ergonomically advantageous applicator container and/or cartridge, at least one cosmetic source. Furthermore, in some embodiments of the cosmetic source applicator, the container can be attached to another container having an elongated configuration that allows its user to access hard-to-reach areas of the body. In addition, in some embodiments of the cosmetic source applicator, the container can be made of multiple materials, such as elastomeric polymer material or wood. In some embodiments of the cosmetic source applicator, the cartridge can be made of multiple materials, such as elastomeric polymer, and be in multiple shapes and sizes, with multiple methods that allow the cosmetic source to be held within, or on the surface of the cartridge. In accordance with the aspects of the present disclosure, a system is provided for applying and finishing cosmetic sources. The system can include a container, cartridge and cosmetic source. The user will not have to purchase separate travel size cosmetic sources, or invest in a product that lasts longer than needed or desired. Each cartridge will have an association with, or be, a cosmetic source, desired by the user, which will allow for a single-use application and finishing of the cosmetic source, with the cartridge then recycled, disposed of appropriately, or washed and reused. The single-use cartridge will not require a user to clean or take care of anything after use, other than recycling, or proper disposal of the used cartridge, while the applicator container is kept for future use. Multiple-use cartridges, allow the user to not worry about storage of the unused cosmetic source, due to the cartridge being stored in the container until use has been exhausted. Furthermore, the cosmetic source applicator system of the present invention promotes a clean and ergonomic method of application and finalization of cosmetic source(s), as germs (bacteria) are prevented from collecting on the skincare/cosmetic product, or other cosmetic sources used.

BRIEF DESCRIPTION OF THE SEVERAL VIEWS OF THE DRAWING

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples of systems, apparatuses, and/or methods for applying cosmetic sources. The examples described herein provide cosmetic source applicator containers suitable for use with cosmetic source applicator cartridges. In some examples described herein, the container can be ergonomically advantageous for use on the body. In other examples described herein, the container can be ergonomically advantageous for use on the face.

In examples set forth herein, the containers of the cosmetic source applicator can hold cartridges of various types of cosmetic sources. In other examples set forth herein, the containers of the cosmetic source applicator can hold cartridges that are cosmetic sources. However, in the most preferred embodiments of the present invention two ergonomically advantageous containers each suitable for use with cosmetic source applicator cartridges each having a release tab for easy removal from the container into which it is held during use, at least one container having an elongated configuration allowing a user to access hard-to-reach areas of the body when the two containers become releasably attached to one another. Bumpers may also be used within a container to properly align cosmetic source applicator cartridges in the container, and each container may have an opening through which a user can release a used or spent cartridge.

In examples set forth herein, the cosmetic source applicator containers can be attached together in accordance with aspects of present disclosure. In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1:
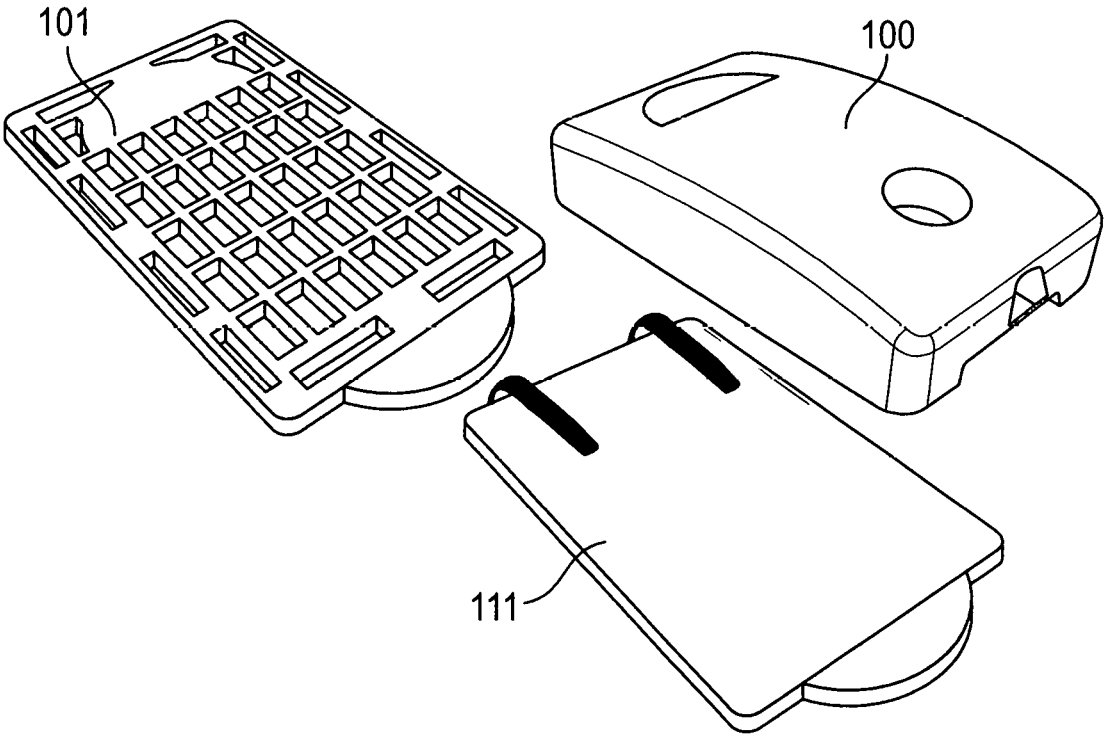
FIG. 1 is a perspective view of one example of a cosmetic source applicator container and two cartridges in accordance with aspects of the present disclosure.
Figure 7:
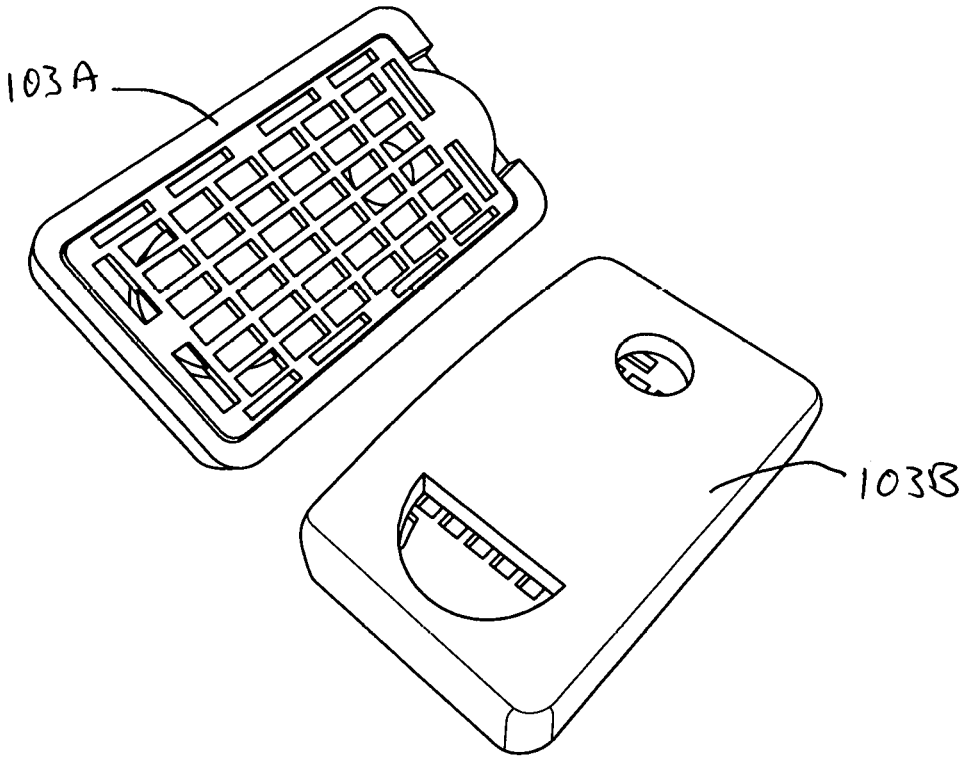
FIG. 7 includes perspective views of a cosmetic source applicator cartridge inserted and held by the container of FIG. 1.
Figure 11:
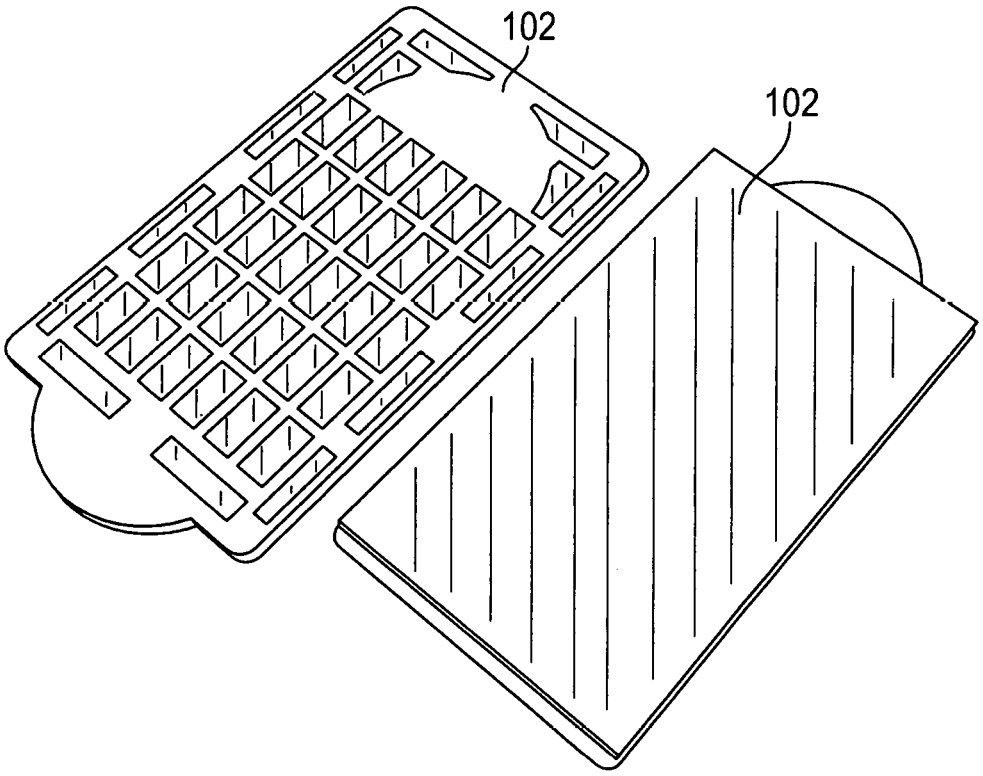
FIG. 11 includes perspective views of two examples of a cosmetic source inserted and held by the cartridge 101 shown in FIG. 1, which collectively becomes identified as fully loaded cartridge 102, the cosmetic source present in multiple small quantities, with FIG. 11 also showing a second cartridge 102 appearing to contain a single quantity of cosmetic source.

Moving now to FIG. 1, there is shown one example of a cosmetic source applicator container, generally designated 100, formed in accordance with aspects of the present disclosure. The cosmetic source applicator container 100 is suitable for use with a cosmetic source applicator cartridge, such as the cartridge 101 also shown in FIG. 1. Cartridge 101 can be inserted into, and removed from container 100, as depicted in FIG. 7. The cartridge can contain cosmetic sources as depicted in FIG. 11, which thereafter may be designated by the number 102 as a ready-to-use cartridge 102. Ready-to-use cartridges 102 when inserted into container 100 can be used to decorate the skin of the user or other individual (not shown). There can be various sizes, shapes, materials, and designs of cartridges (101, 201, 102, and other) that hold various types of cosmetic sources, in accordance with aspects of the invention disclosure herein.

Figure 2:
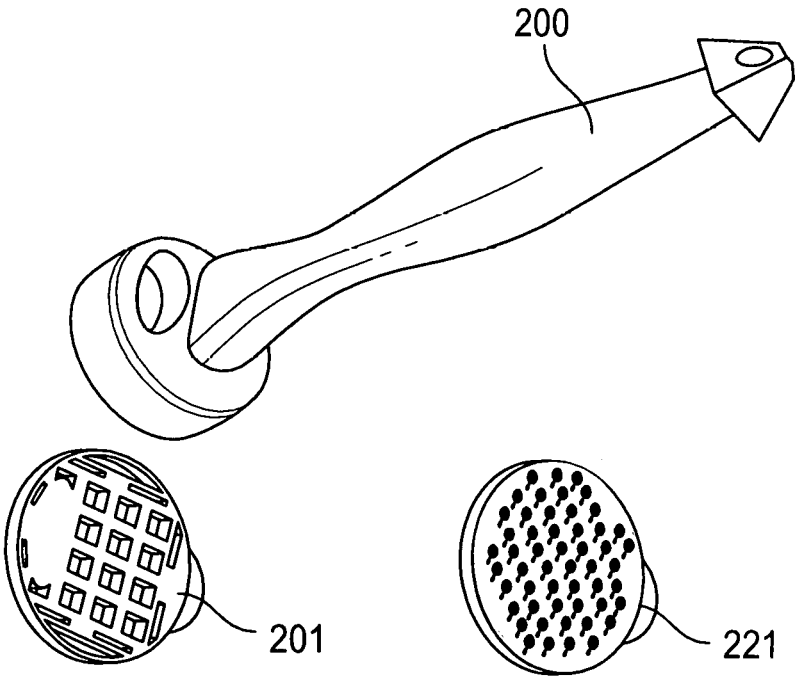
FIG. 2 is a perspective view of another example of a cosmetic source applicator container having a more elongated configuration and two cartridges in accordance with aspects of the present disclosure.
Figure 8:
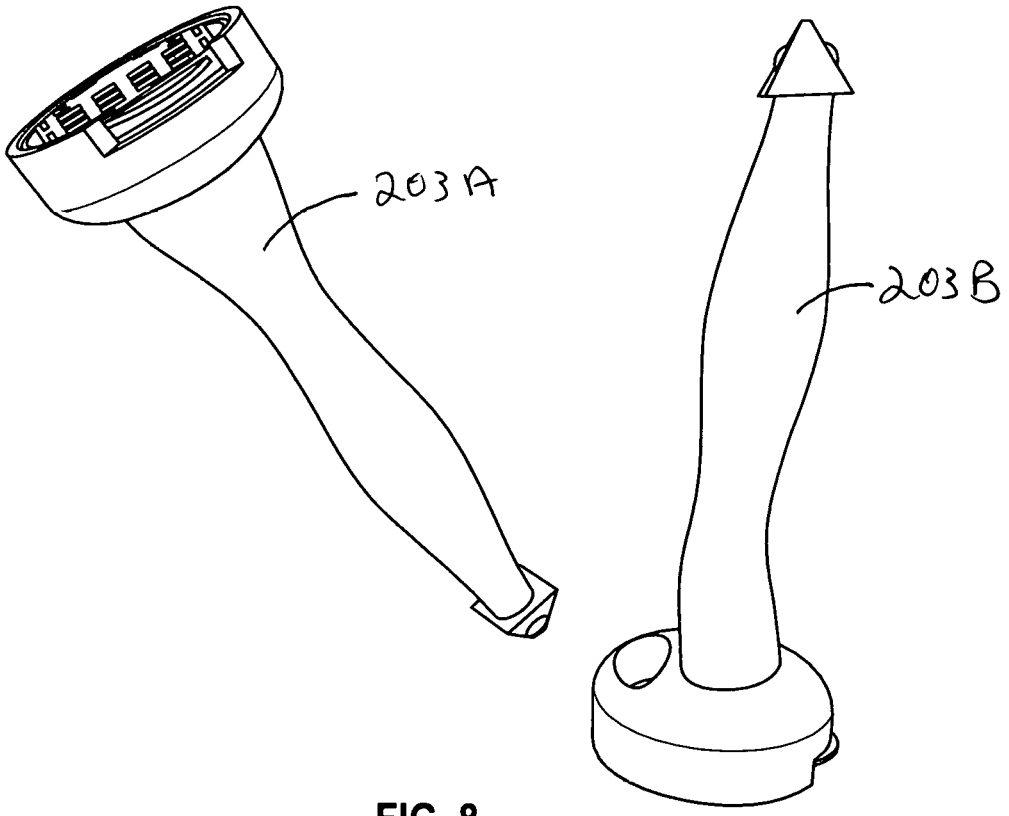
FIG. 8 includes perspective views of a cosmetic source applicator cartridge inserted and held by the container of FIG. 2.
Figure 12:
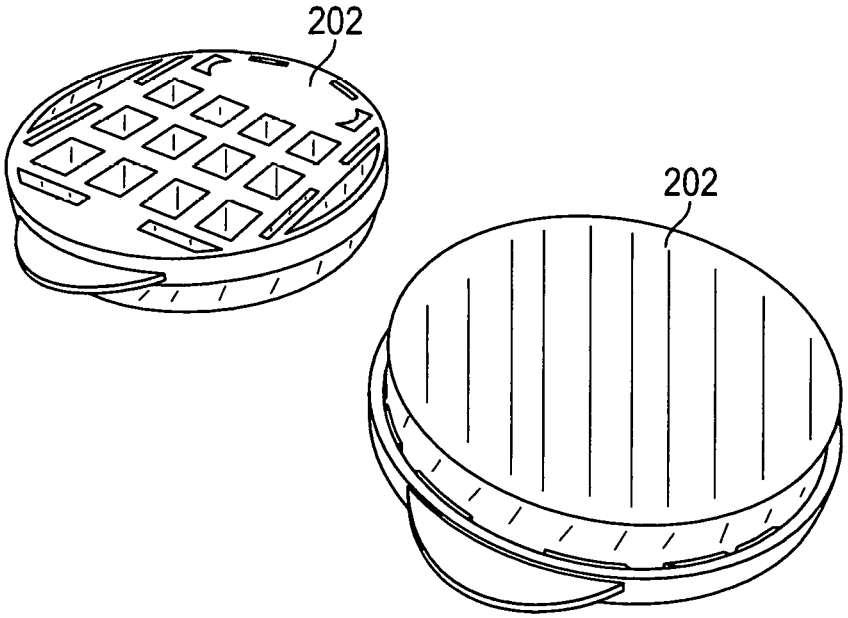
FIG. 12 includes perspective views of two examples of a cosmetic source inserted and held by the cartridge 201 shown in FIG. 2. which collectively becomes identified as fully loaded cartridge 2, the cosmetic source present in multiple small quantities, with FIG. 12 also showing a second cartridge 102 appearing to contain a single quantity of cosmetic source.

Moving now to FIG. 2, there is shown one example of a cosmetic source applicator container, generally designated 200, formed in accordance with aspects of the present invention disclosure. The cosmetic source applicator container 200 is suitable for use with a cosmetic source applicator cartridge, such as cartridge 201. Cartridge 201 can be inserted into, and removed from container 200, as depicted in FIG. 8. The cartridge 201 can contain cosmetic sources and thereafter be depicted as a ready-to-use cartridge 202, as shown in FIG. 12. Cartridge 202 when inserted into container 200 can be used to decorate the skin of the user and/or other individual. There can be various sizes, shapes, materials, and designs of cartridges that hold various types of cosmetic sources, in accordance with the present disclosure.

Figure 3:
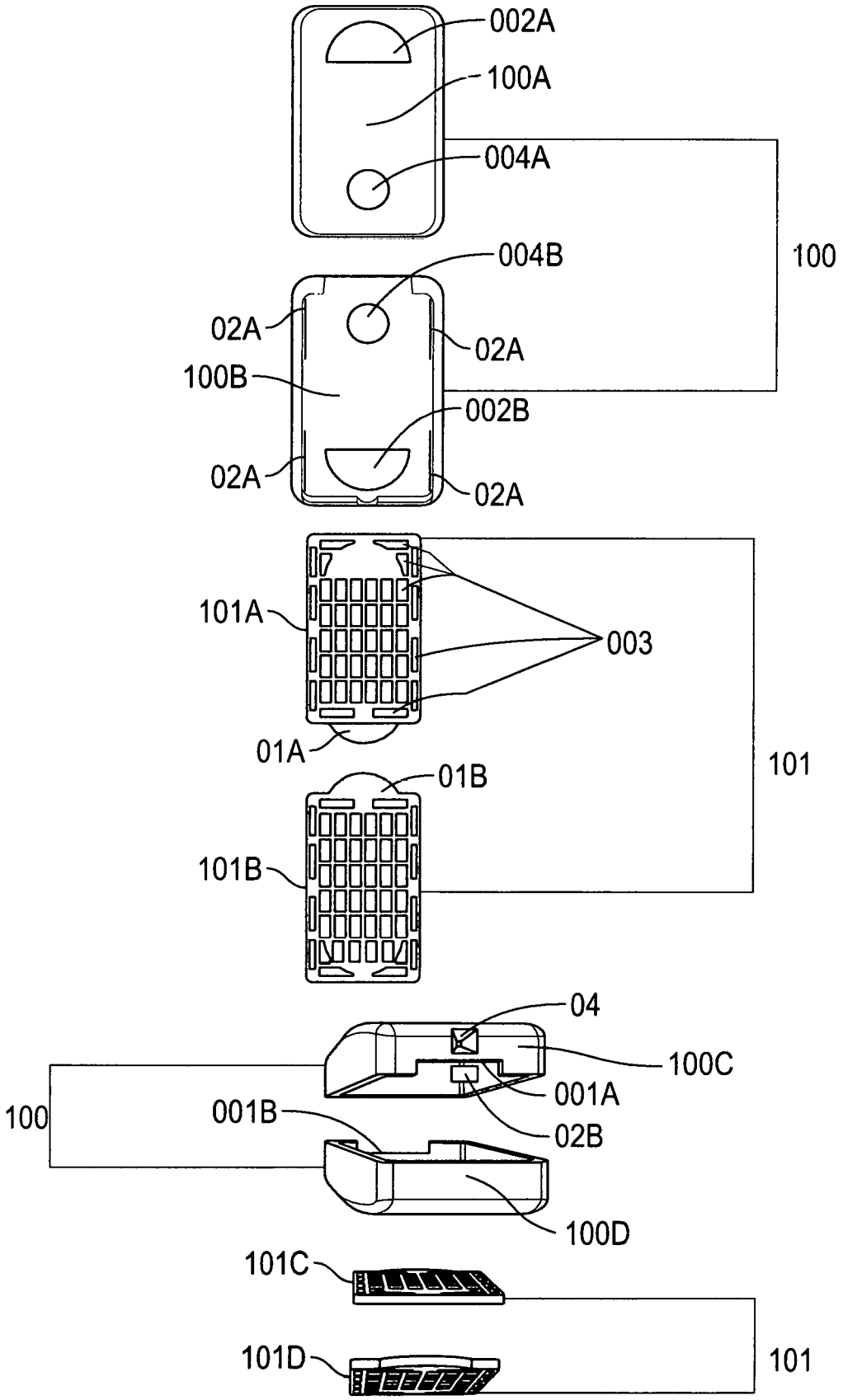
FIG. 3 is a diagram of components previously shown in FIG. 1, a cosmetic source applicator container and cartridge in accordance with aspects of the present disclosure.
Figure 4:
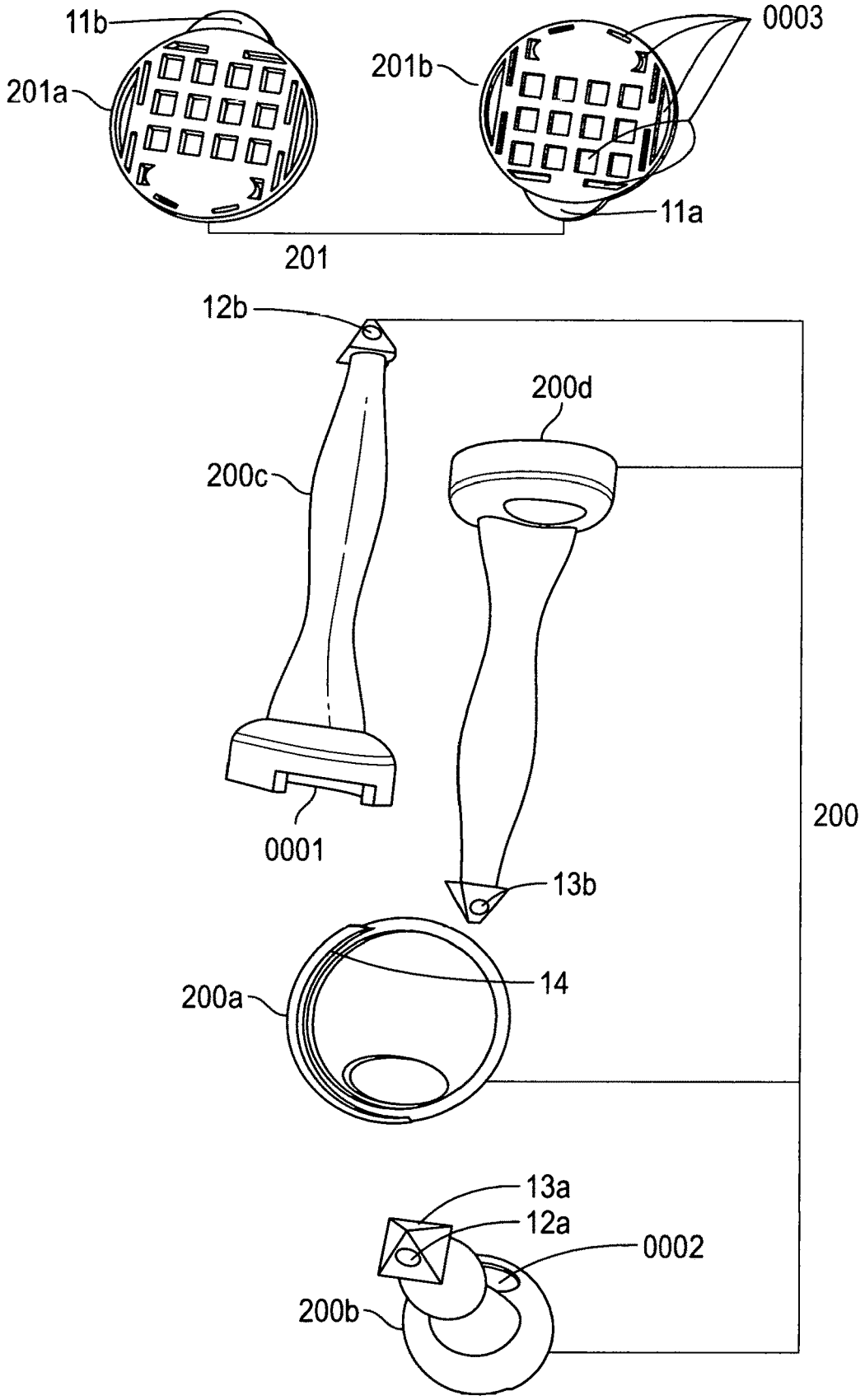
FIG. 4 is a diagram of components previously shown in FIG. 2, a cosmetic source applicator container and cartridge in accordance with aspects of the present disclosure.
Figure 15:
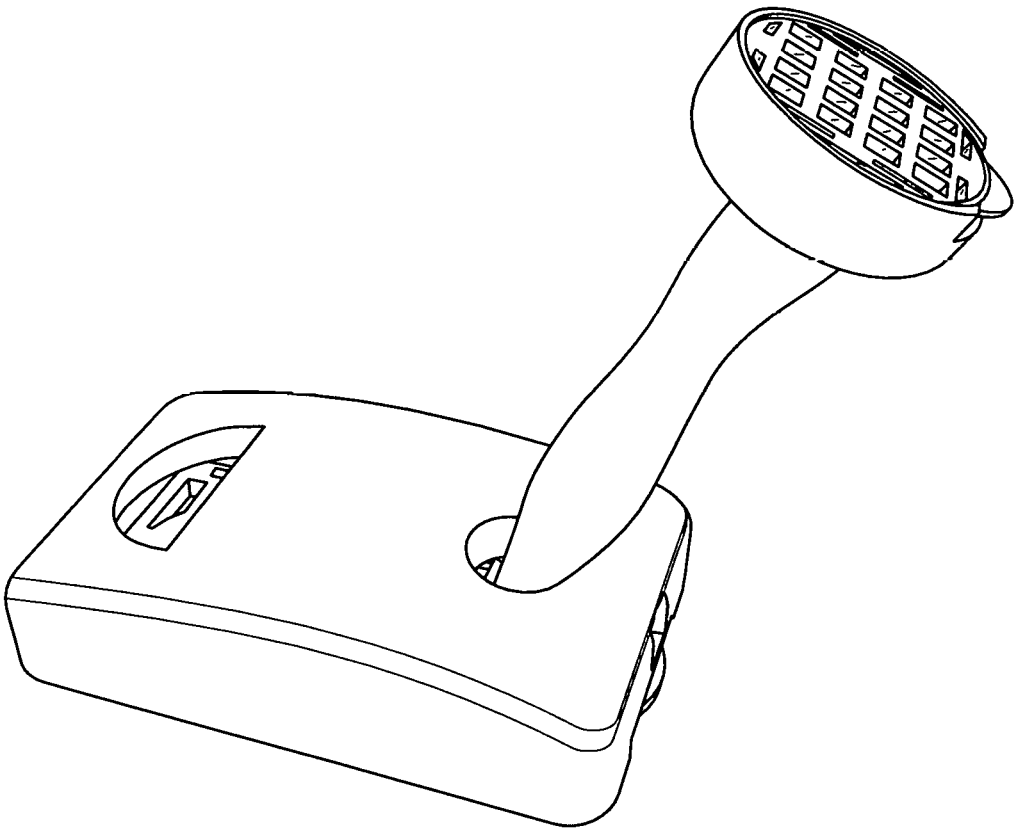
FIG. 15 includes a perspective view of a FIG. 2 applicator container inserted into FIG. 1 applicator container. and the FIG. 1 container providing support for the FIG. 2 container to maintain the FIG. 2 applicator container in a vertically extending orientation FIG. 16 includes perspective views of FIG. 11 cartridge inserted into FIG. 1 container in a position of use.

FIG. 3 is a diagram showing various views (top, bottom, front, and back) of the cosmetic source applicator container 100 and cartridge 101 components previously shown in FIG. 1. These components are as follows: with the number 100A identifying a Top View of cosmetic source applicator container 100; the number 100B identifying a Bottom View of cosmetic source applicator container 100; the number 101A identifying a Top View of cartridge 101; and the number 101B identifying a Bottom View of cartridge 101. Similarly in FIG. 3, the number 100C identifies a Back View of cosmetic source applicator container 100; the number 100D identifies a Front Upside Down View of cosmetic source applicator container 100; the number 101C identifies a Front View of cartridge 101; and the number 100D identifies a Back View of cartridge 101. Other components of the present invention are also identified in FIG. 3, including the numerical designation of 01A to identify a Top View of tab 01 used to aid removal of cartridge 101 from cosmetic source applicator container 100; the numerical designation of 01B to identify a Bottom View of a Tab used to aid removal of cartridge 101 from cosmetic source applicator container 100; and the numerical designation of 02A to identify a bottom view of bumpers associated with cosmetic source applicator container 100 and used to prevent cartridge 101 from inserting too far into container 100. In addition in FIG. 3, the numerical designation of 001A identifies a Back View of an opening that allows cartridge 101 to be removed by use of tab 01 (as depicted in FIG. 3 by the numbers 01A, 01, and 01B); the numerical designation of 001B is the Front Upside Down View of an open slot usable for removal of cartridge 101 via tab 01 from a supporting container 100; and the numerical designations of 002A and 002B respectively identify top and bottom views of the opening 002 in cosmetic source applicator container 100 that allows a user to push out cartridge 101. Furthermore in FIG. 3, the numerical designations of 003 identify grid-like openings in cartridge 101 that allow for the cosmetic source to be held by cartridge 101 and become ready-to-use loaded cartridge 102 (see FIG. 11); and the numerical designation of 004 (also the numerical markings of 004A and 004B identifying top and bottom views of opening 004) shows an opening through the bottom surface of container 100 that a user of a second container (such as container 200 in FIG. 4) could employ for temporary support of container 200 in a position where it remains easily accessible to the user and also protects the loaded cartridge 202 it supports, as shown in FIG. 15. In addition, FIG. 3 shows a container-connecting receiver opening 04 in container 100 adjacent to its open slot 001, with receiver opening 04 used for securely joining two containers together during skin enhancement use (such as a container 100 joined to a container 200 which would allow extended user reach for skin decoration on difficult-to-reach recipient skin). Receiver opening 04 is configured to receive connective structure on a second container (such as container 200 and its tapered end that is marked by the numbers 12, 13 on its distal end (as depicted in FIG. 4 by the numbers 12A, 12B, 13A, and 13B), resulting in the connected configurations shown in FIG. 9 and FIG. 10. Thus, FIG. 3 clearly shows container 100 having a bottom surface 100A (the opposing top surface thereof identified by the numerical designation of 100B), opposing front and back surfaces (visible in Views 100D and 100C), and side surfaces between the front and back surfaces (visible in Front View 100D and Back View 100C), with the front, back, and side surfaces (visible respectively in Top View 100B, Front View 100D, and Back View 100C) together defining an open bottom recess. The Bottom View 101A and Top View 101B in FIG. 3 also show the bottom surface of container 100 having a push-out opening 002 (Bottom and Top Views thereof respectively designated as 002A and 002B). Push-out opening 002 is situated near the front surface of container 100. While push-out opening 002 is not visible in Front View 100D, it does show the front surface of container 100. Front View 100D and Back View 100C both show the back surface 100C of container 100 having an open slot 001 remotely positioned from the bottom surface (visible in Bottom View 100A). While FIG.

Figure 9:
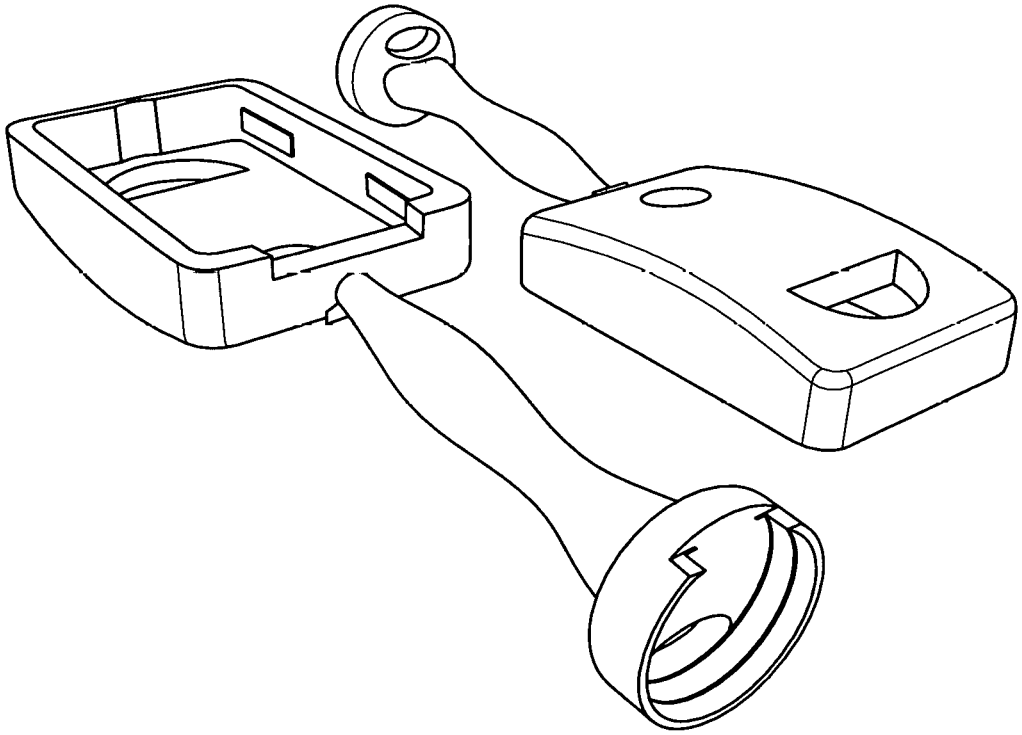
FIG. 9 includes perspective views of a cosmetic source applicator container of FIG. 1 attached to a cosmetic source applicator container of FIG. 2, and no cartridges installed in either container.
Figure 10:
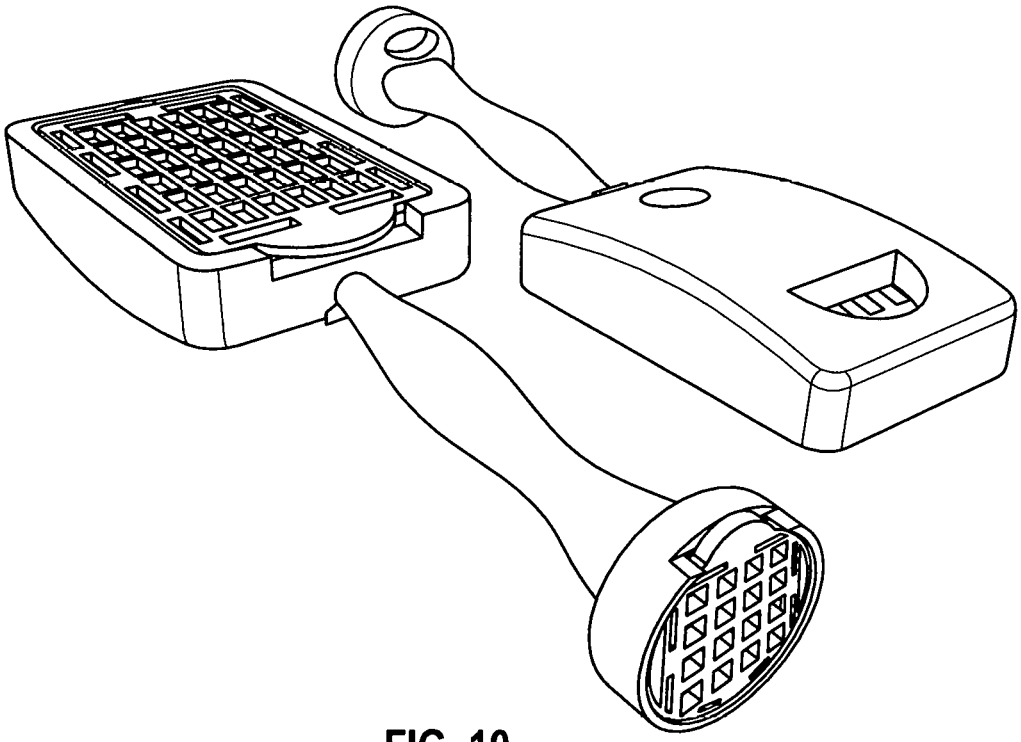
FIG. 10 includes perspective views similar to those in FIG. 9 with a cartridge installed in each container.
Figure 13:
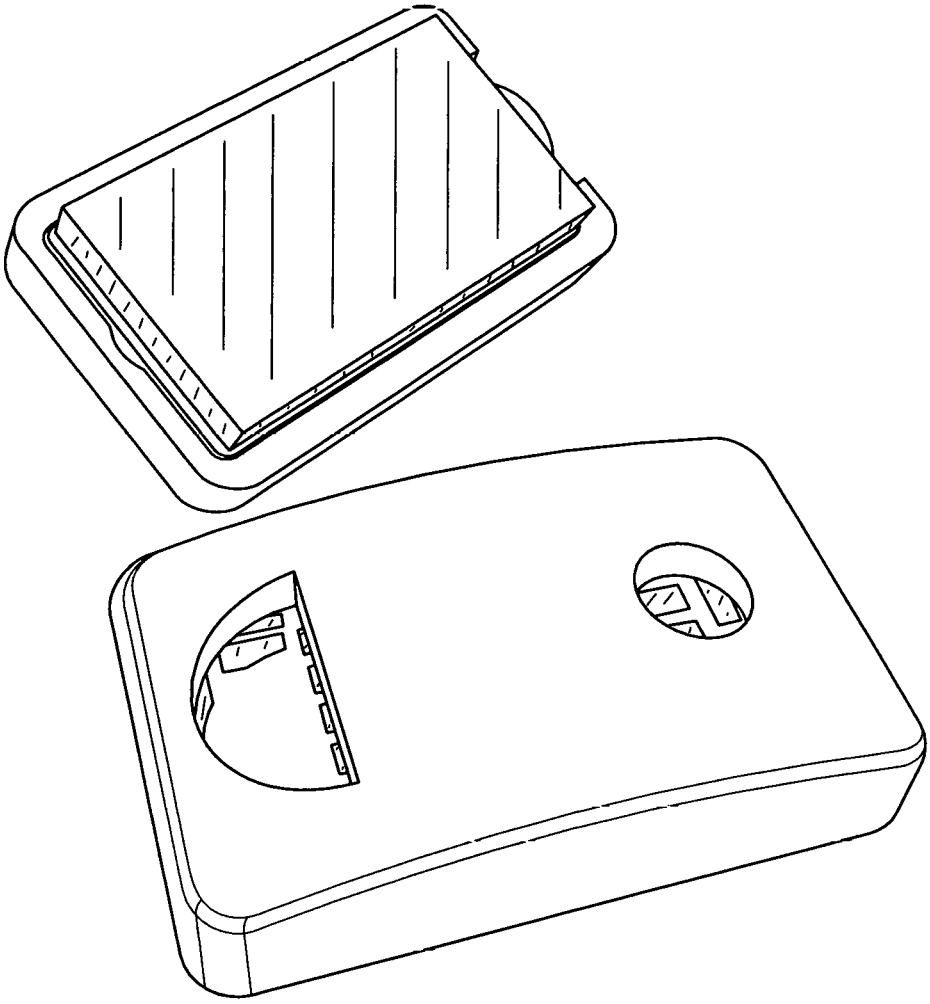
FIG. 13 includes perspective views of the cartridge with small quantities of a cosmetic source shown in FIG. 11 now inserted and held by the container of FIG. 1, with the small quantities of cosmetic source positioned to face the container for protection purposes.
Figure 14:
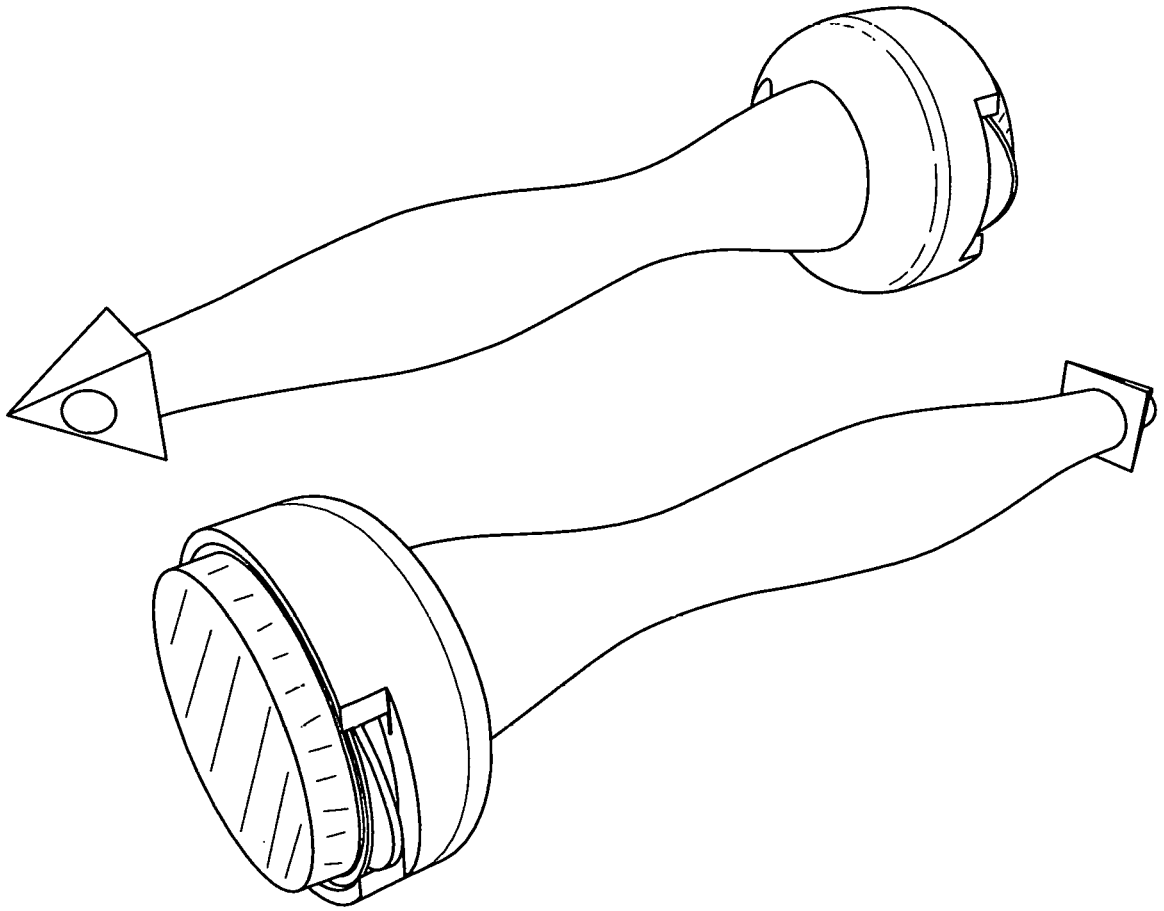
FIG. 14 includes perspective views of a cartridge in FIG. 12 inserted and held by the container of FIG. 2.
Figure 16:
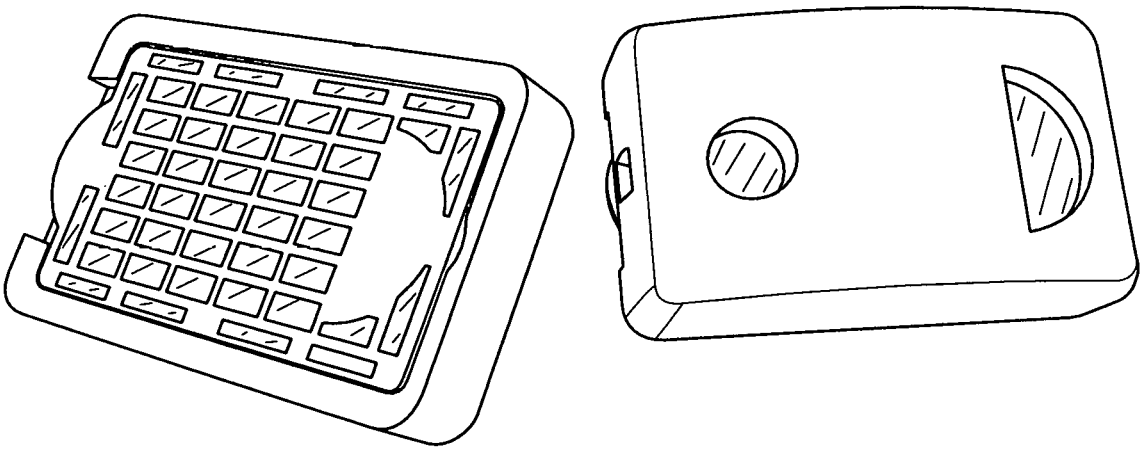

3 does not show container 100 supporting a cartridge 101 over its open bottom recess that is formed by the front, back, and side surfaces of container 100 (visible in Top View 100B, Front View 100D, and Back View 100C), FIGS. 7, 10, 13, and 16 provide illustrations of a cartridge 101 supported by a container 100. Regarding cartridge 101, FIG. 3 shows Top, Bottom, Front, and Back Views thereof (visible as 101A, 101B, 101C, and 101D), all of which show that a cartridge 101 can have both top and bottom surfaces each configured for receipt of at least one cosmetic source (also shown in FIGS. 11, 13, and 16). Furthermore, FIGS. 1, 3 and 5 each show a cartridge 101 with front, back, and side surfaces between its opposing top and bottom surfaces (101A and 101B), that identify a smaller height dimension for cartridge 101 than the height dimension of the container 100 intended for cartridge 101 support during cosmetic source application to a recipient skin surface. In addition, FIGS. 7, 10, 13, and 16 show a cartridge 101 supported by container 100 to form assembly 103, wherein cartridge 101 remains positioned near the top opening of the bottom recess present in container 100, and with its tab 01 extending through the container's open slot 001. FIG. 3 also shows the cartridge 101 having tab 01 associated with its back surface (visible in Back View 101D), but does not show tab 01 extending through open slot 001 and beyond the back surface of container 100. Instead, illustrations of tab 01 extending through open slot 001 and beyond the back surface of container 100 are shown in FIG. 7, FIG. 10, FIG. 13, FIG. 15, and FIG. 16. In addition, although FIG. 3 does not show any cosmetic source configured to decorate, clean, protect, and treat skin surfaces, illustrations that display a cosmetic source associated with container 100 and cartridge 101 are displayed in FIGS. 11-16. In addition, FIGS. 13 and 16 show cartridge 101 in a reversed position within container 100, wherein a pushing force applied through the push-out opening 002 in FIG. 3 in the bottom surface of container 100 and/or a force applied to tab 01 in a direction away from container 100 can be used to release a supported cartridge 101 from container 100, with the top and bottom surfaces of the released cartridge 101 then being reversed in positioning with container 100 then able to provide secure support for the released cartridge 101 with reversed top surface and bottom surface positioning. FIG. 4 reveals a second embodiment of the cosmetic source applicator invention having similar structural features to that shown in FIG. 3, including a container having a bottom recess used to support an interchangeable cartridge, respectively designated in FIG. 4 by the numbering 200 and 201, and a push-out opening 0002 used for release of a supported interchangeable cartridge 201 in the same manner and with the same purpose that the push-out opening 002 in container 100 is used. However, FIG. 4 also discloses differences in containers 100 and 200, noticeably the rectangular configuration in container 100 is replaced by a circular configuration in container 200. Another difference is elongated tapering structure extending outward from the bottom surface of the open bottom recess in container 200 that ends in a tapered configuration designated as tapered end 12/13 that is sized and configured for engagement with the receiving opening 04 in container 100 for secure connection of containers 100 and 200 to one another, as shown in FIGS. 9 and 10. FIG. 4 also shows the elongated structure of container 200 having one ergonomic shape preferred for cosmetic source application on difficult to reach recipient skin. More discussion of FIG. 4 is provided in the following paragraph.

Figure 5:
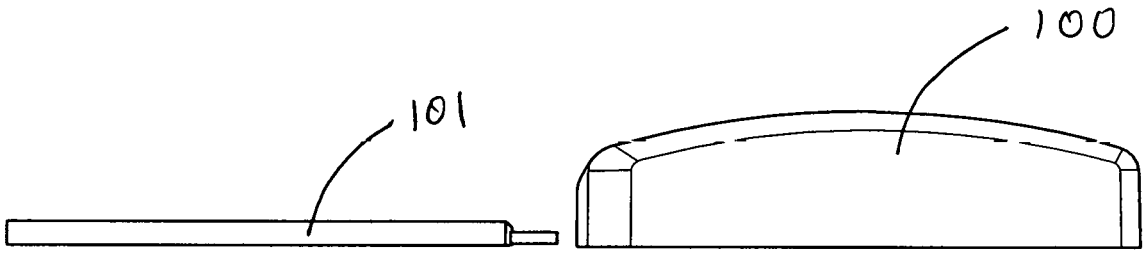
FIG. 5 is a side view of components previously shown in FIG. 1, a cosmetic source applicator container and cartridge in accordance with aspects of the present disclosure.
Figure 6:
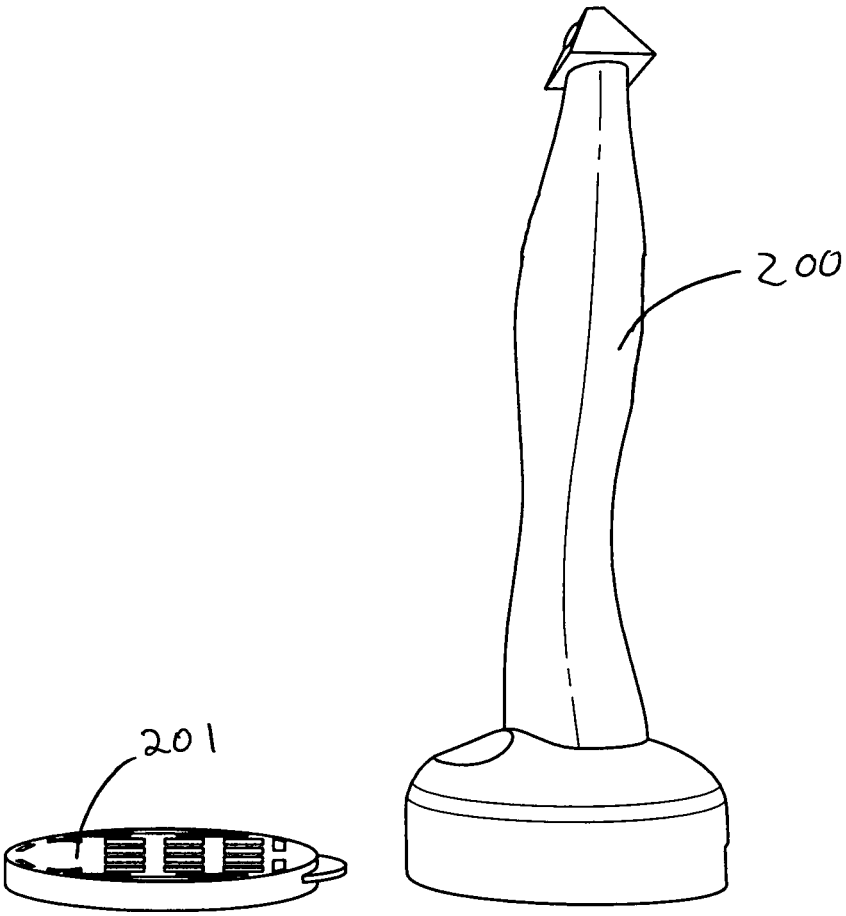
FIG. 6 is a side view of components previously shown in FIG. 2, a cosmetic source applicator container and cartridge in accordance with aspects of the present disclosure.

In contrast, FIG. 4 is a diagram showing various views (top, bottom, front, and back) of the cosmetic source applicator container 200 and cartridge 201 components previously shown in FIG. 2. These components are as follows: the numerical designation of 200*a* is a Front View of cosmetic source applicator container 200; the numerical designation of 200*b* is a Back View of cosmetic source applicator container 200; the numerical designation of 201*a* is a Bottom View of cartridge 201; and the numerical designation of 201*b* is a Top View of cartridge 201; while the numerical designation of 200*c* is a Bottom View of cosmetic source applicator container 200; and the numerical designation of 200*d* is a Top View of cosmetic source applicator container 200. In contrast, FIG. 5 shows side views of the cosmetic source applicator container 100 and cartridge 101 that were previously illustrated in FIG. 1, with each situated adjacent to one another before support of cartridge 101 by container 100 for storage or use. FIG. 6 is a similar side view of the cosmetic source applicator container 200 and cartridge 201 that were previously shown in FIG. 2 and in accordance with aspects of the present disclosure, with each situated adjacent to one another before support of cartridge 201 by container 200 for storage or use. In contrast, FIG. 7 shows the cartridge 101 of FIG. 5 inserted into and held by the cosmetic source applicator container 100 (also shown in FIG. 5) to form the combined cosmetic applicator structure identified by the number 103 (or assembly 103), with 103A showing a bottom view thereof and 103B showing a top view thereof. Similarly, FIG. 8 shows perspective views of a cosmetic source applicator cartridge 201 inserted and held by an elongated container 200 (each previously illustrated in FIG. 6), to form the combined cosmetic applicator structure identified by the numbers 203A and 203B (or assembly 203), with 203A showing a bottom view thereof and 203B showing a side view thereof. FIG. 9 shows two perspective views from opposing ends of the cosmetic source container 100 (as previously shown in FIG. 5) while attached to a cosmetic source applicator container 200 (previously shown in FIG. 6). Also, FIG. 10 shows two perspective views from opposing ends of the assembly 103 (previously shown in FIG. 7) attached to the assembly 203 previously shown in FIG. 8. Furthermore, the numerical designation of 11*a* identifies a Top View of Tab 11 that can be used to aid removal of cartridge 201 from cosmetic source applicator container 200; while the numerical designation of 11*b* identifies a bottom view of tab 11 that can be used to aid removal of cartridge 201 from cosmetic source applicator container 200. Furthermore, the numerical designation of 14 indicates a Front View of bumpers used to prevent cartridge 201 from inserting too far into cosmetic source applicator container 200. In addition, the number 0001 identifies a Bottom View of opening to allow cartridge 201 to be removed from container 200 by use of tab 11 (as depicted in FIG. 4 as 11*a* and 11*b*); the number 0002 identifies the Front View of the opening to allow for the user to push out cartridge 201; 0003 are the openings in the top and bottom surfaces of cartridge 201 that allow for the cosmetic source to be held by cartridge 201 and become loaded cartridge 202 (shown in FIGS. 12; 12*a* and 13*a* represent Back Side Views (with 12*b* and 13*b* respectively representing Bottom and Top Views) of the pyramid-shaped tip that allows container 200 connection to container 100 when inserted into container connection opening 04 (as depicted in FIG. 3) for attachment of containers 200 and 100 as indicated in FIG. 9 and FIG. 10.

Also, with respect to FIG. 11 and FIG. 12, two examples of loaded cartridges (102 and 202) are shown which after use can be disposed of, recycled, or reused (dishwasher safe, and microwaveable). Furthermore, the loaded cartridges 102 and 202 can be the actual cosmetic source, or hold the cosmetic source in a way which is depicted consistent with the present disclosure. Moreover, the loaded cartridges 102 and 202 can be prepared for single-use, or multiple-use. The loaded cartridges 102 and 202 material could be of many different substances in accordance with aspects of the present disclosure. In addition, the loaded cartridge 102 in FIG. 11 is also shown in FIG. 13 with one of its opposing top and bottom surfaces in a position of use, while FIG. 16 shows the opposing surfaces of the loaded cartridge 102 reversed while securely supported by a container 100. Similarly, FIG. 12 shows the loaded cartridge 202 in FIG. 14 with one of its opposing top and bottom surfaces in a position of use, while FIG. 15 shows the opposing surfaces of the loaded cartridge 202 reversed while securely supported by a container 200.

Also, with respect to FIG. 1 and FIG. 2, each display a different example of a cosmetic source applicator container, each of which various materials, in accordance with aspects of the present disclosure, can be used to make each container 100 and 200. Further, as depicted in FIG. 15, the container 200 of FIG. 2 can be inserted into and supported by the container 100 of FIG. 1, at its opening 004 when not being used (see numerical designation of temporary support opening 004 marked in FIG. 3). This will allow for a neat, efficient, and effective way of storing the containers 200, when not being used or between uses.

With respect to FIG. 16, loaded cartridge 102 can be inserted and stored in container 100 when not being used, or in between uses. This allows for a neat, efficient, and effective way of storing container 100 and loaded cartridge 102, when not being used, or between uses.

With respect to FIG. 11, loaded cartridge 102 can have any have any cosmetic source inserted, or attached for use on the skin, in accordance with aspects of the present disclosure.

With respect to FIG. 12, loaded cartridge 202 can have any have any cosmetic source inserted, or attached for use on the skin, in accordance with aspects of the present disclosure. With respect to FIG. 3, openings marked by the numbering 001A, 002A, and 002B in container 100 allow for the user to release and remove cartridge 101, or loaded cartridge 102, from its supporting container 100. Openings 003 allow for the cosmetic source to be inserted and held in cartridge 101, which results in loaded cartridge 102. Opening 004 allows for the bottom end of container 200 (per FIG. 4) to be inserted (see FIG. 9 and FIG. 10), and removed as desired by the user. With respect to FIG. 4, openings 0001 and 0002 allow for the user to remove cartridge 201, or loaded cartridge 202. Opening 0003 allow for the cosmetic source to be inserted and held in cartridge 201, which results in the designation of loaded cartridge 202.

The methods described above can be carried out to apply a cosmetic source to a user's or other individual's skin, and to finish the cosmetic source on the user's or other individual's skin. However, any type of cosmetic source, such as other personal care sources, can be used as part of the method disclosed above.

It should be noted that for purposes of this disclosure, terminology used for directional, location or movement purposes should be construed as descriptive and not limiting the scope of the claimed subject matter. Further, the use of "including", "comprising", "has", or "having" and variations thereof herein is meant to encompass the items listed thereafter and equivalents thereof as well as additional items. Unless limited otherwise, the terms, "attached", "inserted" and variations thereof herein are used broadly and encompass direct and indirect connections, attachments, and inserts.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A cosmetic source applicator for use by those wanting to apply products to skin on any part of the body to decorate, clean, protect, and treat a recipient skin surface for enhancement thereof, said cosmetic source applicator comprising:

two containers, at least one interchangeable cartridge, and at least one cosmetic source applicable for skin surface enhancement, a first one of said two containers having a bottom recess with a rectangular configuration and the second one of said two containers having a bottom recess with a circular configuration, said at least one interchangeable cartridge sized and configured for secure support by one of said two containers during skin enhancement use;

each of said two containers further having a bottom surface, front, back, and side surfaces together defining said open bottom recess with a height dimension, said back surface further having an open slot remotely positioned from said bottom surface, said first container further having a size and configuration adapted for hand manipulation and securely supporting one said at least one interchangeable cartridge over said rectangular open bottom recess, and said second container further having a size and configuration adapted for hand manipulation and securely supporting one said at least one interchangeable cartridge over said circular open bottom recess;

said first container also comprising a receiver opening and said second container also comprising structure adapted for receipt in said receiver opening wherein a secure connection between said first container and said second container becomes established for skin enhancement use;

said at least one interchangeable cartridge sized and configured for support by one of said two containers, said at least one interchangeable cartridge also having opposed top and bottom surfaces, and front, side, and back surfaces together defining a height dimension between said opposed top and bottom surfaces that is smaller than said height dimension of said open bottom recess in said container so that when one said at least one interchangeable cartridge is selected for individual support by said container, said selected cartridge achieves positioning remote from said bottom surface of said container during skin surface enhancement use and aligns with said open slot, each said at least one interchangeable cartridge further having a tab associated with said back surface and configured to facilitate release and removal of said cartridge from said container to conclude individual support by said container, said tab also configured and positioned to extend through said open slot and beyond said back surface of said container when supported by said container during skin surface enhancement use; and said at least one cosmetic source and said selected cartridge associated by one of said two containers during recipient skin surface enhancement use, said at least one cosmetic source configured and adapted to decorate, clean, protect, and treat recipient skin surfaces, wherein when said cosmetic source applicator is hand-manipulated with said at least one cosmetic source in contact with a recipient skin surface, enhancement of the recipient skin surface occurs, and further when a force is applied to said tab in a direction away from said bottom surface of the one said two containers supporting it, release and removal of said supported interchangeable cartridge from said container is facilitated, and thereafter said opposing top and bottom surfaces of said released interchangeable cartridge can be reversed in positioning for additional individual support by said container with the reversed one of said opposing surfaces of said interchangeable cartridge thereafter individually supported by said container for contact with a recipient skin surface and enhancement thereof.

2. The cosmetic source applicator of claim 1 wherein said structure in said second container adapted for receipt in said receiver opening of said first container and establishing a secure connection between said first container and said second container during skin enhancement use is elongated and has a tapered tip.

3. The cosmetic source applicator of claim 2 wherein said tapered tip is pyramid-shaped.

4. The cosmetic source applicator of claim 2 wherein said first container further comprises a temporary support opening configured for insertion of said tapered tip of said second container when not being employed for skin enhancement use.

5. The cosmetic source applicator of claim 1 wherein at least one of said two containers comprises at least one bumper adapted for assisting retention of each said at least one interchangeable cartridge while individually supported by said container during skin enhancement use.

6. The cosmetic source applicator of claim 5 wherein positioning of said at least one bumper within said container in combination with said height dimension of said cartridge together allow said individually supported interchangeable cartridge to extend outwardly beyond said open bottom recess.

7. The cosmetic source applicator of claim 1 wherein said at least one interchangeable cartridge is selected from a group consisting of cartridges configured for use on the body, cartridges configured for use on the face, cartridges configured for use on the hand, cartridges configured for use on the foot, and cartridges configured for use on the scalp.

8. The cosmetic source applicator of claim 1 wherein materials for said two containers are selected from a group consisting of water-resistant materials and waterproof materials.

9. The cosmetic source applicator of claim 1 wherein materials for said at least said at least one interchangeable cartridge are selected from a group consisting of dishwasher safe materials, recyclable materials, microwave safe materials, and flexible materials.

10. The cosmetic source applicator of claim 1 wherein said at least one cosmetic source is selected from a group consisting of cosmetic sources adapted for distribution onto a recipient skin surface, cosmetic sources adapted to decorate a recipient skin surface, cosmetic sources adapted to clean a recipient skin surface, cosmetic sources adapted to protect a recipient skin surface, and cosmetic sources adapted to treat a recipient skin surface.

11. The cosmetic source applicator of claim 1 wherein said wherein said cosmetic source comprises at least one product selected from a group consisting of personal soaps, personal deodorants, makeup, makeup removers, shampoos, conditioners, body washes, skin care products, loofas, exfoliators, massagers, and hair care products.

12. The cosmetic source applicator of claim 1 wherein said at least one interchangeable cartridge is selected from a group consisting of interchangeable cartridges having at least one cosmetic source completely covering said top surface and interchangeable cartridges having at least one cosmetic source completely covering said bottom surface.

13. The cosmetic source applicator of claim 1 wherein said at least one interchangeable cartridge is selected from a group consisting of interchangeable cartridges having at least one cosmetic source partially covering said top surface and interchangeable cartridges having at least one cosmetic source partially covering said bottom surface.

14. The cosmetic source applicator of claim 1 wherein said at least one interchangeable cartridge is selected from a group consisting of interchangeable cartridges having at least one opening on said top surface filled with at least one said at least one cosmetic source and interchangeable cartridges having at least one opening on said bottom surface filled with at least one said at least one cosmetic source.

15. The cosmetic source applicator of claim 1 wherein said at least one interchangeable cartridge is selected from a group consisting of interchangeable cartridges having a plurality of cosmetic receiving openings on said top surface filled with at least one said at least one cosmetic source and interchangeable cartridges having a plurality of cosmetic receiving openings on said bottom surface filled with at least one said at least one cosmetic source.

16. The cosmetic source applicator of claim 15 wherein said cosmetic source receiving openings in said at least one interchangeable cartridge are selected from a group consisting of openings uniform in shape, openings uniform in size, openings forming a grid-like arrangement, openings having more than one shape, and openings having more than one size.

17. The cosmetic source applicator of claim 1 wherein said at least one interchangeable cartridge is a cosmetic source capable of being distributed onto a recipient skin surface.

18. The cosmetic source applicator of claim 1 wherein said back surface of at least one of said two containers further comprises a push-out opening sized and configured to assist release and removal of each said at least one cartridge selected for individual support by said container.

19. The cosmetic source applicator of claim 1 wherein said at least one interchangeable cartridge has opposing top and bottom surfaces each configured for receipt of said at least one cosmetic source.

20. The cosmetic source applicator of claim 1 wherein said at least one interchangeable cartridge is selected from a group consisting of single use cartridges, reusable cartridges, and disposable cartridges.

* * * * *